US008429770B2

(12) United States Patent
Hooley et al.

(10) Patent No.: US 8,429,770 B2
(45) Date of Patent: Apr. 30, 2013

(54) CONVERTIBLE SOFA WITH CONTAINED AIR MATTRESS

(75) Inventors: Timothy M. Hooley, Elkhart, IN (US); Robert K. Swihart, Goshen, IN (US)

(73) Assignee: Flair Interiors, Inc., Goshen, IN (US)

( * ) Notice: Subject to any disclaimer, the term of this patent is extended or adjusted under 35 U.S.C. 154(b) by 0 days.

(21) Appl. No.: 13/486,477

(22) Filed: Jun. 1, 2012

(65) Prior Publication Data

US 2012/0233832 A1 Sep. 20, 2012

Related U.S. Application Data

(62) Division of application No. 11/838,352, filed on Aug. 14, 2007, now Pat. No. 8,201, 290.

(60) Provisional application No. 60/838,513, filed on Aug. 17, 2006.

(51) Int. Cl.
*A47C 17/04* (2006.01)

(52) U.S. Cl.
USPC ..... 5/35; 5/1; 5/12.1; 5/28; 5/16; 5/43

(58) Field of Classification Search ..... 5/1, 12.1, 5/706, 103, 130, 118, 35, 13, 16, 28, 42.1, 5/43
See application file for complete search history.

(56) References Cited

U.S. PATENT DOCUMENTS

| | | | | |
|---|---|---|---|---|
| 100,789 | A | 3/1870 | Needham | |
| 113,576 | A | 4/1871 | Schmtit | |
| 284,617 | A | 9/1883 | D'Arman | |
| 327,605 | A | 10/1885 | Shaw | |
| 583,179 | A | 5/1897 | Holman | |
| 907,311 | A | 12/1908 | Bowdon | |
| 1,053,774 | A | 2/1913 | Bennett | |
| 1,240,500 | A * | 9/1917 | Sisbower | 5/45 |
| 1,511,079 | A | 10/1924 | Inco | |
| 1,612,687 | A | 12/1926 | Young | |
| 2,209,880 | A | 7/1940 | Fox | |
| 2,329,503 | A | 9/1943 | Young | |
| 2,648,071 | A * | 8/1953 | Reilly | 5/45 |
| 2,671,228 | A | 3/1954 | DeMaria | |

(Continued)

FOREIGN PATENT DOCUMENTS

| | | |
|---|---|---|
| AT | 412318 | 1/2005 |
| CA | 1047203 | 1/1979 |

(Continued)

OTHER PUBLICATIONS

Machine translation of FR2618316 Jul. 31, 2010.

*Primary Examiner* — Robert G Santos
*Assistant Examiner* — Brittany Wilson
(74) *Attorney, Agent, or Firm* — Woodard, Emhardt, Moriarty, McNett & Henry LLP

(57) ABSTRACT

A sofa is convertible to a bed. An air mattress normally stored in deflated condition in the sofa, is automatically deployed upon opening a folded framework into a bed. An electric pump inflates or deflates the mattress. A bag enclosing the bottom and sides of the mattress, is zipped onto the mattress, and has hook-and-loop fasteners securing it to strategic locations on the framework. The conversion from sofa to bed, and back to sofa, is done without removing any cushions and without moving the sofa away from anything behind it.

15 Claims, 13 Drawing Sheets

U.S. PATENT DOCUMENTS

| | | | |
|---|---|---|---|
| 2,843,181 | A | 7/1958 | Paschen |
| 2,876,462 | A | 3/1959 | Martin |
| 3,088,127 | A | 5/1963 | Eames |
| 3,736,601 | A | 6/1973 | Riches |
| 3,792,501 | A | 2/1974 | Kery |
| 3,879,598 | A | 4/1975 | Darling |
| 3,965,499 | A | 6/1976 | Dunning, III |
| 3,994,033 | A | 11/1976 | Bendell |
| 4,082,355 | A | 4/1978 | Knabusch et al. |
| 4,104,747 | A | 8/1978 | Bell et al. |
| 4,110,854 | A | 9/1978 | Sjolie |
| 4,153,958 | A | 5/1979 | Paulik |
| 4,165,124 | A | 8/1979 | Olan |
| 4,169,295 | A | 10/1979 | Darling |
| 4,186,452 | A | 2/1980 | Underwood |
| 4,204,287 | A | 5/1980 | Lane et al. |
| 4,226,470 | A | 10/1980 | Wittmann et al. |
| 4,259,755 | A | 4/1981 | Hollander |
| 4,366,585 | A | 1/1983 | Ponti et al. |
| 4,402,096 | A | 9/1983 | Atimichuk |
| 4,442,556 | A | 4/1984 | Craigie |
| 4,454,615 | A | 6/1984 | Whitney |
| 4,538,308 | A | 9/1985 | Grigoriev |
| 4,555,821 | A | 12/1985 | Page |
| 4,563,784 | A | 1/1986 | Shrock et al. |
| 4,571,756 | A | 2/1986 | Castro et al. |
| 4,573,225 | A | 3/1986 | Wolf |
| 4,608,722 | A | 9/1986 | Zorzetto |
| 4,619,005 | A | 10/1986 | Rutens |
| 4,694,515 | A | 9/1987 | Rogers |
| 4,779,917 | A | 10/1988 | Campbell et al. |
| 4,829,616 | A | 5/1989 | Walker |
| 4,953,242 | A | 9/1990 | Harris |
| 5,035,464 | A | 7/1991 | Spallholtz |
| 5,039,155 | A | 8/1991 | Suman et al. |
| 5,129,113 | A | 7/1992 | Sherman |
| 5,211,130 | A | 5/1993 | Elias et al. |
| 5,505,513 | A | 4/1996 | Carsner |
| 5,520,436 | A | 5/1996 | Rader et al. |
| 5,549,355 | A | 8/1996 | Illulian |
| 5,652,977 | A | 8/1997 | Vayda |
| 5,787,522 | A | 8/1998 | Swihart |
| 5,794,283 | A | 8/1998 | Vila et al. |
| 6,050,638 | A | 4/2000 | West, III |
| 6,082,805 | A | 7/2000 | Gray et al. |
| 6,108,844 | A | 8/2000 | Kraft et al. |
| 6,135,558 | A | 10/2000 | Behrens et al. |
| 6,161,231 | A | 12/2000 | Kraft et al. |
| 6,295,674 | B1 | 10/2001 | Smith-McKelvey et al. |
| 6,332,760 | B1 | 12/2001 | Chung |
| 6,357,062 | B1 | 3/2002 | Woll et al. |
| 6,463,603 | B1 | 10/2002 | Camfield |
| 6,502,256 | B1 | 1/2003 | McNeil et al. |
| 6,588,837 | B1 | 7/2003 | Schultz et al. |
| 6,594,833 | B2 | 7/2003 | Timoshenko |
| 6,651,274 | B2 | 11/2003 | Swihart et al. |
| 6,665,893 | B2 | 12/2003 | Fruge |
| 6,769,143 | B2 | 8/2004 | Clarke |
| 6,799,339 | B2 | 10/2004 | Stewart |
| 6,848,127 | B2 | 2/2005 | Inagaki |
| 6,857,142 | B2 | 2/2005 | Fruge |
| 6,918,143 | B2 | 7/2005 | Wiberg |
| 6,964,134 | B2 | 11/2005 | Chaffee |
| 6,986,175 | B2 | 1/2006 | Maas |
| 6,990,700 | B2 | 1/2006 | Chung |
| 7,240,381 | B1 | 7/2007 | Hawse |
| 7,269,865 | B2 | 9/2007 | James et al. |
| 7,360,261 | B1 | 4/2008 | Sheliga |
| 7,418,747 | B1 | 9/2008 | Myers |
| 7,748,061 | B2 | 7/2010 | Pine |
| 7,900,999 | B2 | 3/2011 | Reynolds et al. |
| 2002/0130535 | A1 | 9/2002 | Dick et al. |
| 2003/0215340 | A1 | 11/2003 | Chung |
| 2004/0083548 | A1 * | 5/2004 | Wiberg ..... 5/43 |
| 2004/0107498 | A1 | 6/2004 | Maas |
| 2005/0060803 | A1 | 3/2005 | Stewart et al. |
| 2005/0102751 | A1 | 5/2005 | Kang |
| 2005/0144729 | A1 | 7/2005 | Fruge |
| 2009/0025141 | A1 | 1/2009 | Ray et al. |

FOREIGN PATENT DOCUMENTS

| | | | |
|---|---|---|---|
| CA | 1074506 | | 4/1980 |
| CA | 2597770 | | 2/2009 |
| CN | 2139391 | | 8/1993 |
| CN | 2280466 | | 5/1998 |
| CN | 2478466 | | 2/2002 |
| EP | 0688523 | | 12/1995 |
| EP | 0855161 | | 7/1998 |
| EP | 868870 | A2 | 10/1998 |
| EP | 1190649 | A1 | 3/2002 |
| EP | 1442678 | | 8/2004 |
| EP | 1502523 | | 2/2005 |
| FR | 2554335 | | 5/1985 |
| FR | 2 618 316 | | 7/1987 |
| GB | 190710341 | | 12/1907 |
| GB | 191126030 | | 10/1912 |
| GB | 191305087 | | 2/1914 |
| GB | 792949 | | 4/1958 |
| GB | 2 124 897 | A | 2/1984 |
| GB | 2124897 | A * | 2/1984 |
| GR | 1004138 | | 2/2003 |
| PL | 103973 | | 7/1997 |
| PT | 68695 | | 11/1978 |

* cited by examiner

CONVERTIBLE SOFA WITH CONTAINED AIR MATTRESS

REFERENCE TO RELATED APPLICATIONS

This application is a divisional of U.S. patent application Ser. No. 11/838,352, filed Aug. 14, 2007 now U.S. Pat. No. 8,201,290 which claims the benefit of U.S. Provisional Patent Application Ser. No. 60/838,513, filed Aug. 17, 2006, which is hereby incorporated by reference in its entirety.

BACKGROUND OF THE INVENTION

This application relates generally to sofas and more particularly to a sofa that is convertible for use as a bed. Devices that are useful for seating but convertible for use as beds, are well known. Various approaches have been taken to accomplish this. One such approach is to combine conventional cushions with a conventional mattress in a seating unit, with the mattress folded up under the cushions. Another approach is to use cushions for seating and an air mattress for sleeping. It is difficult to combine the features of furniture seating comfort of a sofa and the sleeping comfort of a single purpose bed, in a unit occupying minimal floor space as a seating unit and without the need for space for separately storing seat cushions when used as a bed, or bedding when used as a sofa. In addition, where the sofa is to be used in a recreational vehicle or a mobile home, there are constraints on size and shape. This involves getting the sofa through a doorway and around one or more corners, and placing it at a suitable location in the vehicle. The present invention is addressed to dealing with some such problems.

SUMMARY

According to one aspect of the present invention, a sofa convertible between a sofa configuration and a bed configuration, has at least one seat cushion for seating an occupant, and a back frame supporting at least one back cushion in a position facing forward, and the back frame can be pulled forward and down to support a portion of an air mattress when the sofa is in the bed configuration.

Another aspect is provision of an extension frame normally behind the back frame and which can be pulled up and forward in a movement passing over and forward of the back frame to support a portion of an air mattress when the sofa is in the bed configuration.

Another aspect is provision to hang a deflated air mattress between the back frame and the extension frame for storage of the mattress when the sofa is in the sofa configuration.

Another aspect is strapping holding the air mattress to the extension frame to carry a portion of the air mattress upward and forward and over and forward of the back frame to support a portion of an air mattress when the sofa is in the bed configuration.

Another aspect is moving the back cushion automatically out of the way of the air mattress while converting from the sofa configuration to the bed configuration.

Another aspect is supporting a portion of the air mattress on the seat cushion when the sofa is in the bed configuration.

Another aspect is placing the back frame and extension frame substantially co-planar with the top of the seat cushion when the apparatus is in the bed configuration.

DESCRIPTION OF THE ILLUSTRATED EMBODIMENT

Figure 1:
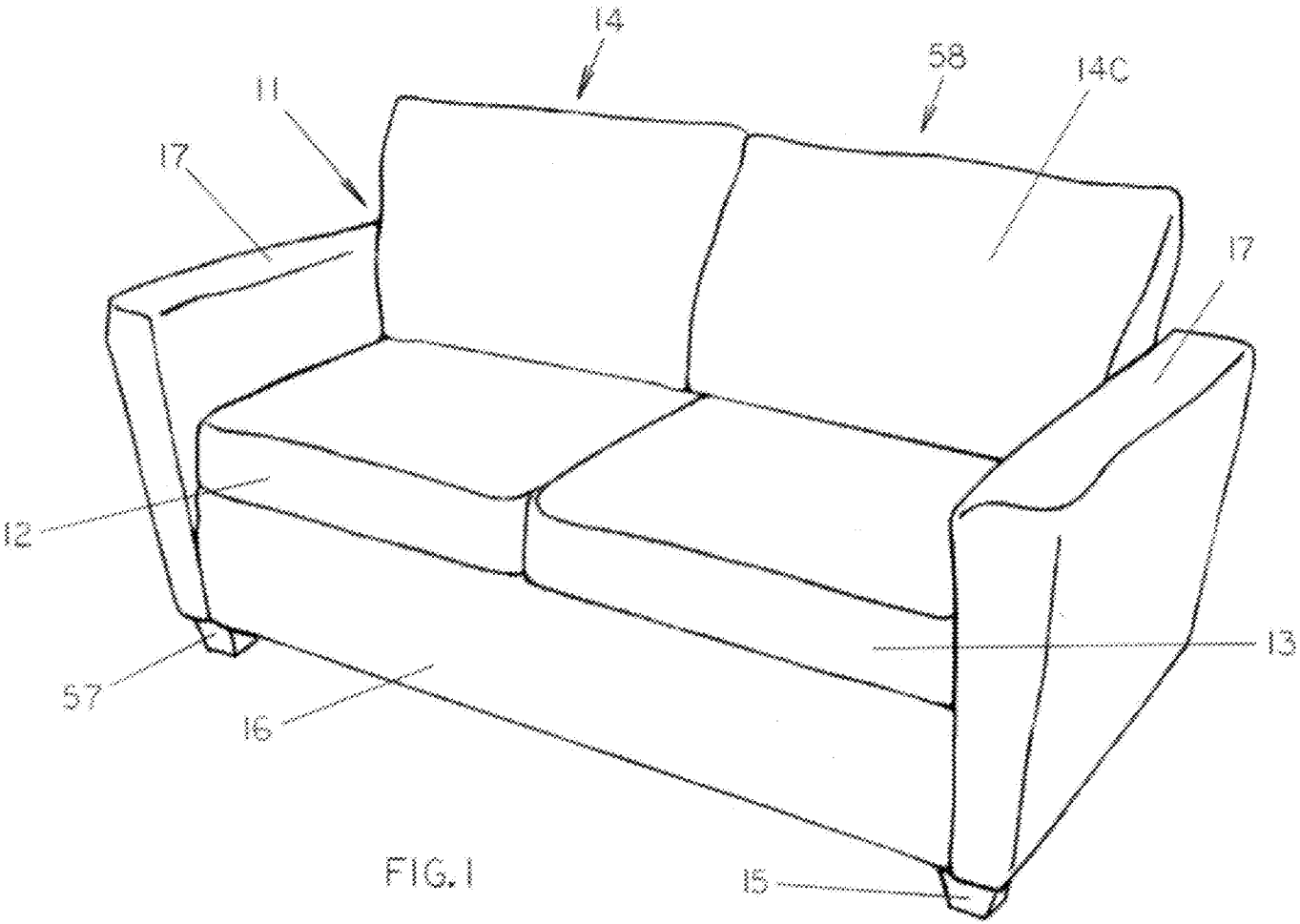
FIG. 1 is a perspective view of a typical embodiment of the present invention in the sofa configuration.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated and described herein being contemplated as would normally occur to one skilled in the art to which the invention relates.

Referring now to the drawings in detail, FIG. 1 shows the apparatus 11 in the sofa configuration. It includes seat cushions 12 and 13, a cushioned back assembly 14 with two back cushions such as 14C and a drawer 16. The sofa has arm rests 17 at each side. Some framework, legs and a non-inflated air mattress at the rear of the cushion back assembly which can be seen in FIG. 2, will be understood from the following description of the framework of the sofa-bed unit. FIG. 3 shows the apparatus converted to the bed configuration.

Referring now to FIGS. 4 through 9, FIG. 4 shows the framework for the unit in its configuration providing the sofa of FIG. 1. It comprises a main frame having a front rail assembly 21, a rear frame rail 22, and left and right side rail assemblies 23. These rails are secured together by nuts and bolts and provide a rigid main frame. A swing-arm 24 is mounted at each side of the main frame on pivots at 26 and rests on stop bolts 25 at both ends of rotation. A roll-over back frame loop 27 made of one inch square steel formed in a rectangle, has a top rail 27T, bottom rail 27B, and end rails 27E with portions which are fixed to the distal end portions of the swing-arms 24 with clips at 24E. This frame loop 27 has a set of wires 28L extending lengthwise of the frame loop, and wires 28C extending transversely. These are welded to the frame loop 27 and to each other and provide attachment of the upholstery and frame support. L-style sinuous springs which are not shown in the drawing attach to the frame loop 27 and provide flexible support for the back cushions of the back assembly 14 of the sofa shown in FIG. 1. The clips 24E are of a type having a tab which can be pulled out to enable pulling the back frame loop off the ends of the arms.

A roll-over extension frame assembly 31 (FIGS. 9 and 15) includes an extension frame loop with upper rail 32 and lower rail 33 and side rails 34, all of which can be formed from square tube or other shape stock to form a loop. Wires 36L extend longitudinally between the side rails 34 and wires 36C extend transversely between the top and bottom rails 32 and 33. These wires are welded to the rails and to each other. They provide support for the air mattress when the assembly is converted to the bed configuration and 36C provides attachment for the strap 76-79 of elastic webbing.

The roll-over extension frame assembly 31 is provided with back roll-over hinge assemblies 37 which are affixed to the side rails 34. Each of the hinge assemblies has a hinge pin 38 at the top and to which a back pivot mount 39 is pinned. The mounts 39 are affixed to the ends 27E of the roll-over frame loop 27.

For support of the seat cushions, there is a cushion frame provided to support a flat spring which is not shown in the drawing to avoid unnecessary complexity in the drawing. The cushion frame includes a rear spring rail 41, a front spring rail 42, and side rails 43. Longitudinal wires 44L are mounted in these side rails and transverse wires 44T are connected across the rear and front spring rails 41 and 42, respectively for frame support and upholstery attachment. End hooks of the springs (not shown) can be received in the apertures shown in the top of each of the front and rear spring rails 42 and 41, respectively, and the spring is otherwise supported on the set of longitudinal and transverse wires. These serve to support the seat cushions 12 and 13 of the sofa of FIG. 1.

Figure 10:
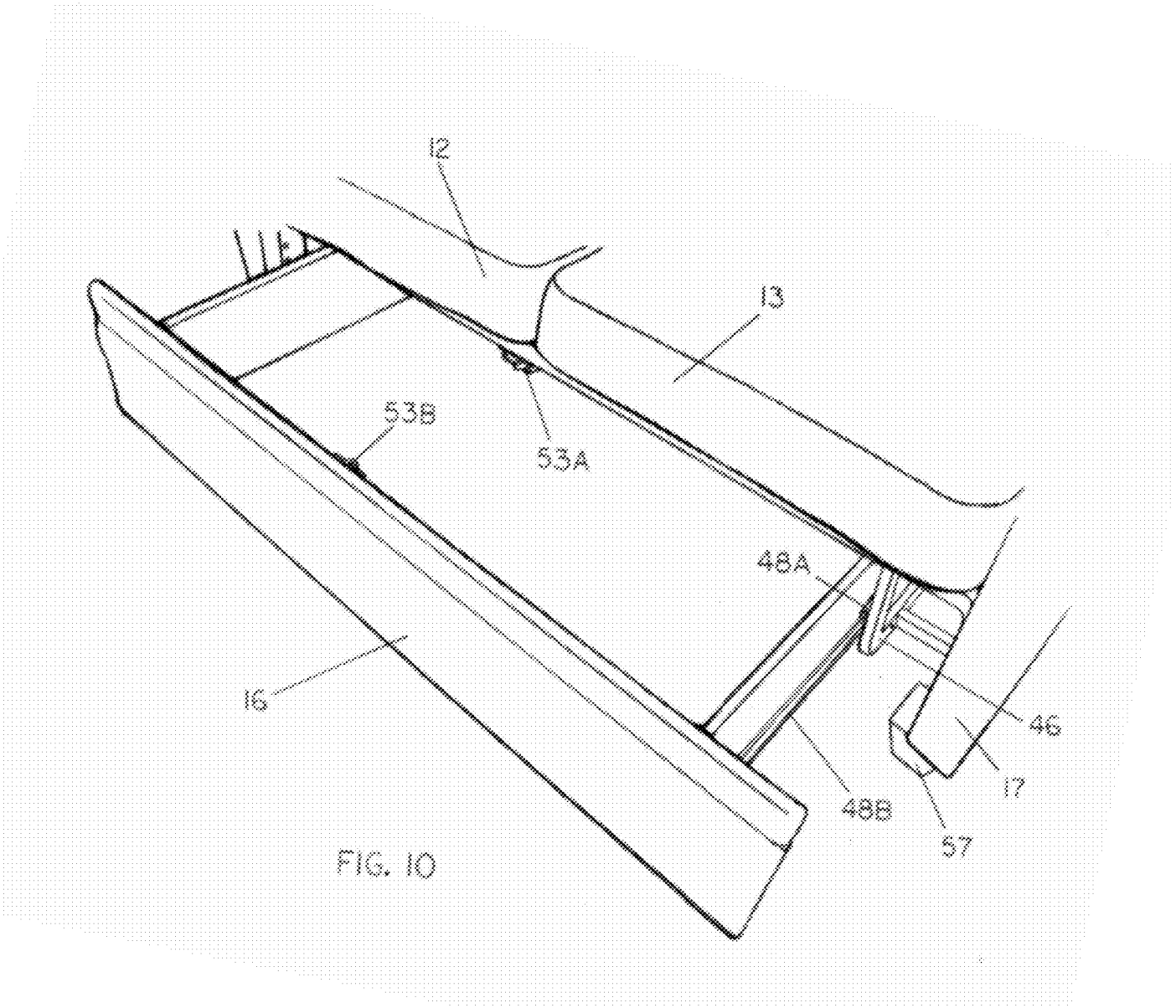
FIG. 10 is a view similar to FIG. 1 but showing the bedding storage drawer opened from which bedding materials have been removed in preparation for conversion of the unit to a bed configuration.
Figure 12:
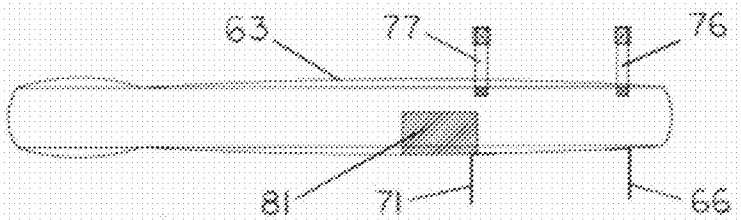
FIG. 12 is a side view thereof.
Figure 13:
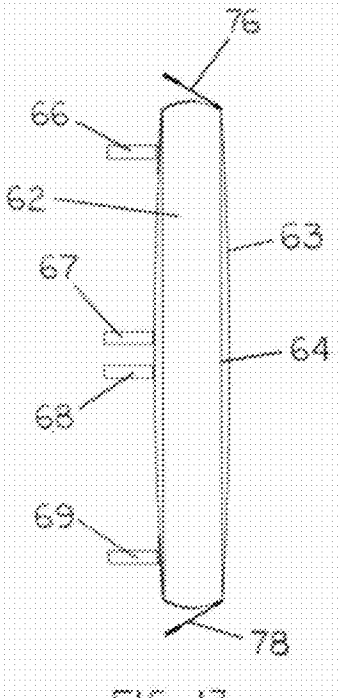
FIG. 13 is an end view thereof.
Figure 11:
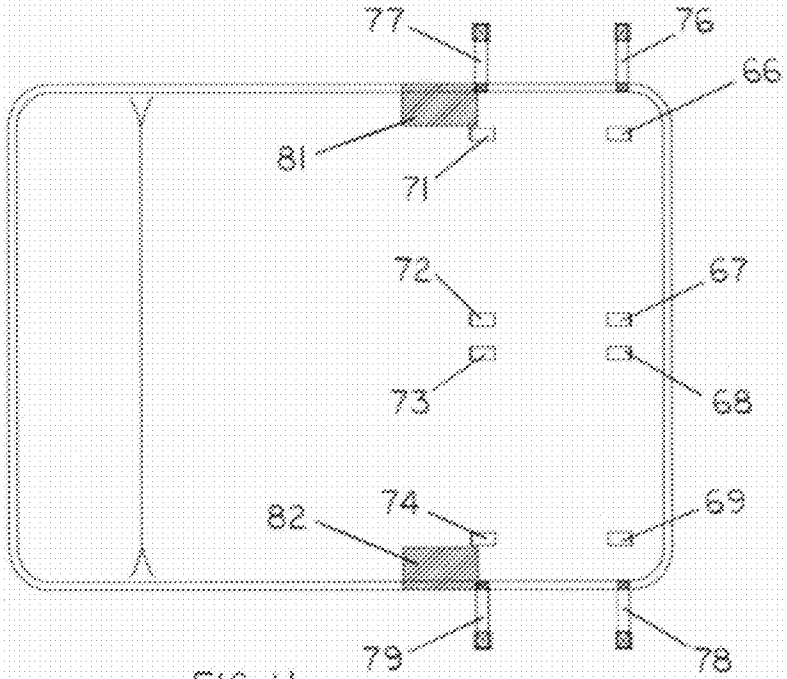
FIG. 11 is a bottom plan view of the air mattress assembly inflated, but separate from the frame to show some specific technical details.

To support the drawer whose outside front face is shown at 16 in FIG. 1, there is a drawer mount assembly at each side. Each one includes a hanger bracket tube 46 which is mounted at the front to the main frame front rail 21 by a hanger bracket 47 at the upturned front end of the bracket tube 46. The rear end of the bracket tube 46 is fastened to the main frame rear side rail 23. These two brackets 46 provide mounts for the drawer slide portions 48A secured to the brackets 46. Thus, the drawer 16 with slide portions 48B on each side riding on side portions 48A, can slide easily outward from under the cushions 12 and 13 to remove bedding materials, blankets, bed pillows and the like, and then be pushed inwardly to close the drawer and then enable converting the sofa to the bed. A conventional bump stop on each slide assembly is useful to limit outward travel of the drawer. As shown in FIG. 10, a two-part catch latch 53A is mounted to the front rail 21 and 53B is mounted to the back side of 16 drawer face, or self latching slide tracks are used to retain drawer closure.

Because it is likely that the purchaser of the sofa will have a choice of fabrics and colors, it is desirable to have a type of leg or foot design material and/or color which would be suitable. To prepare for this, a foot mounting bracket such as 56 is provided at each corner of the main frame and has a nut 56N staked or welded to it to receive a bolt for attachment of feet 57 consistent with the style of materials and trim according to the desired character of the sofa.

Figure 2:
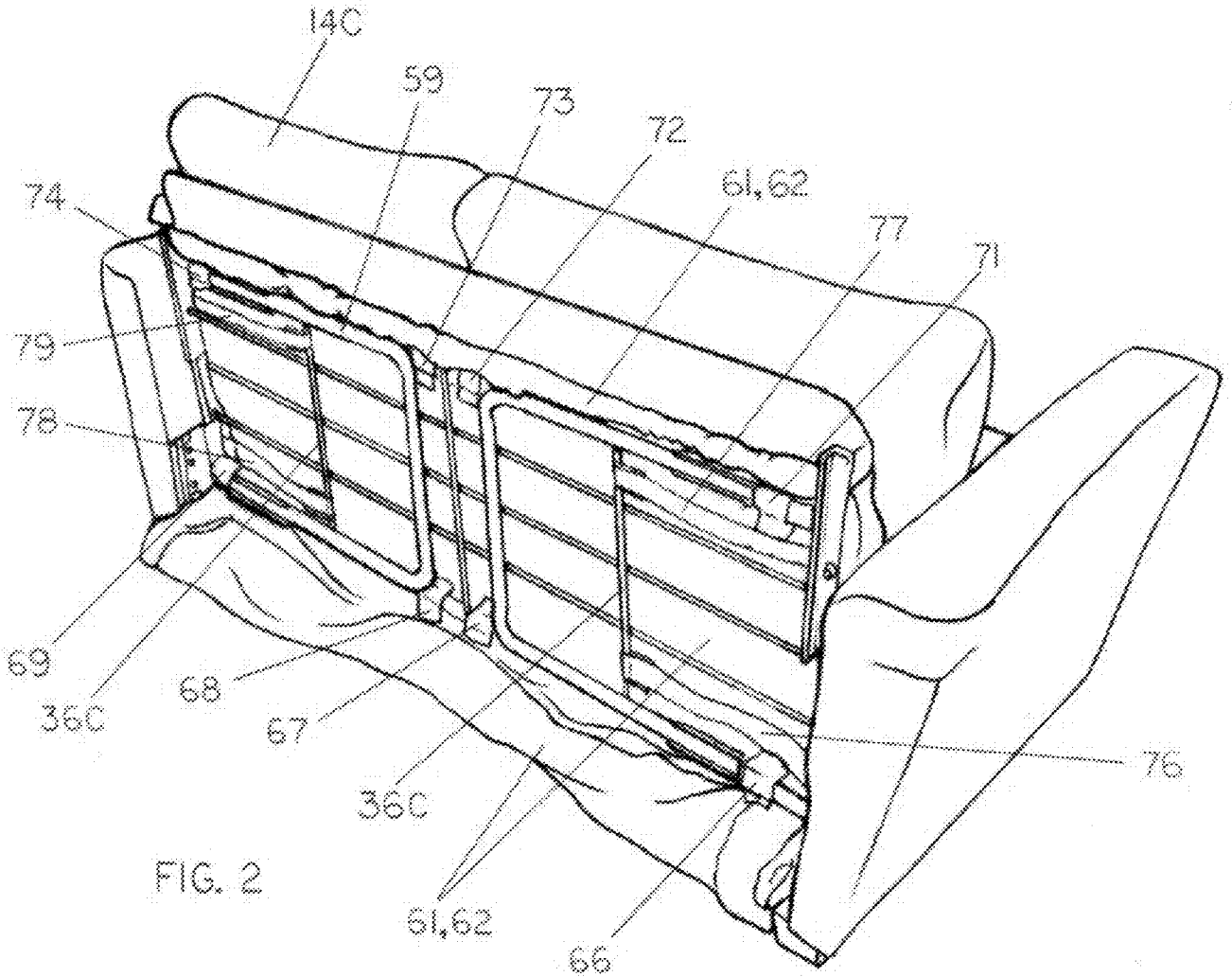
FIG. 2 is a rear perspective view of the unit of FIG. 1.
Figure 3:
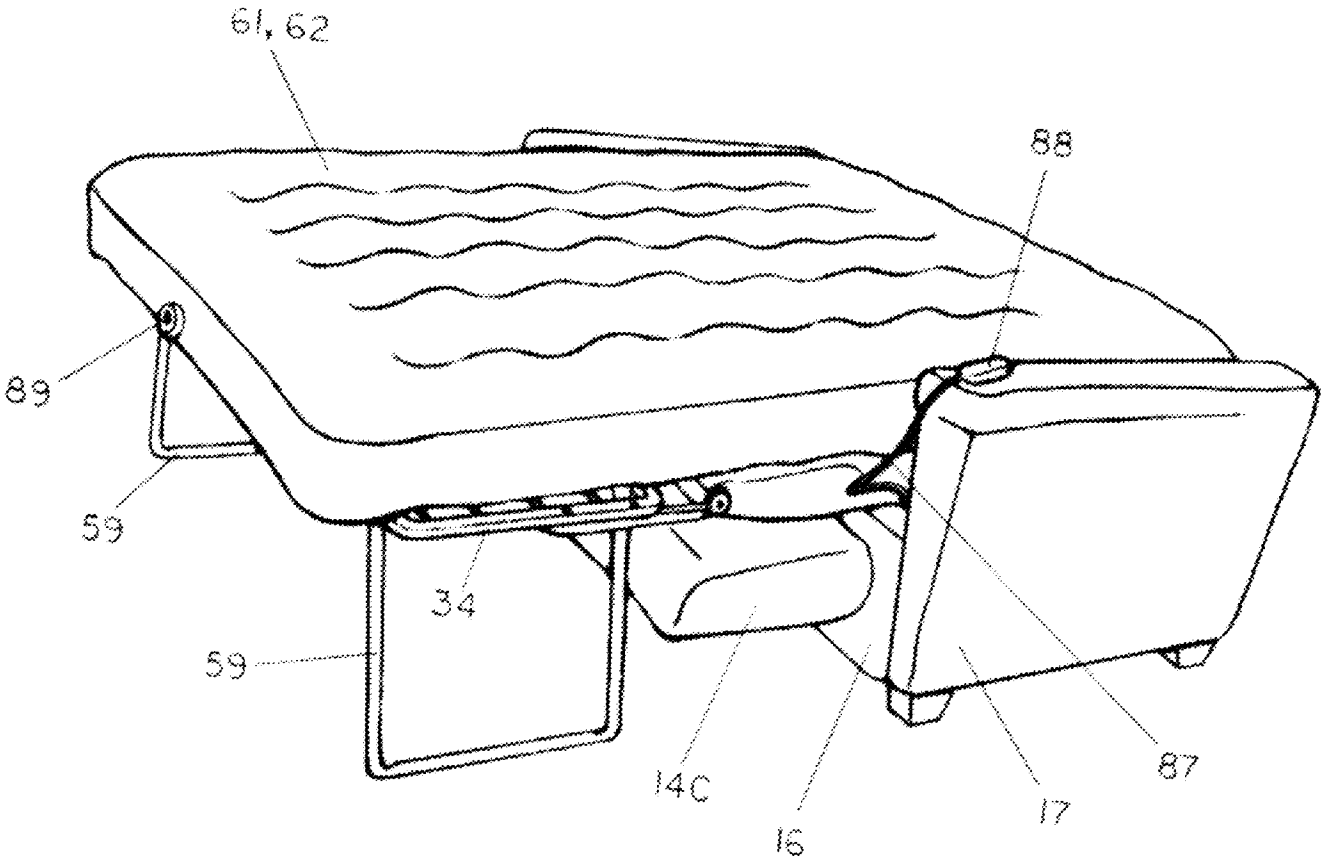
FIG. 3 is a front perspective view of the unit in the sleeping bed configuration.
Figure 4:
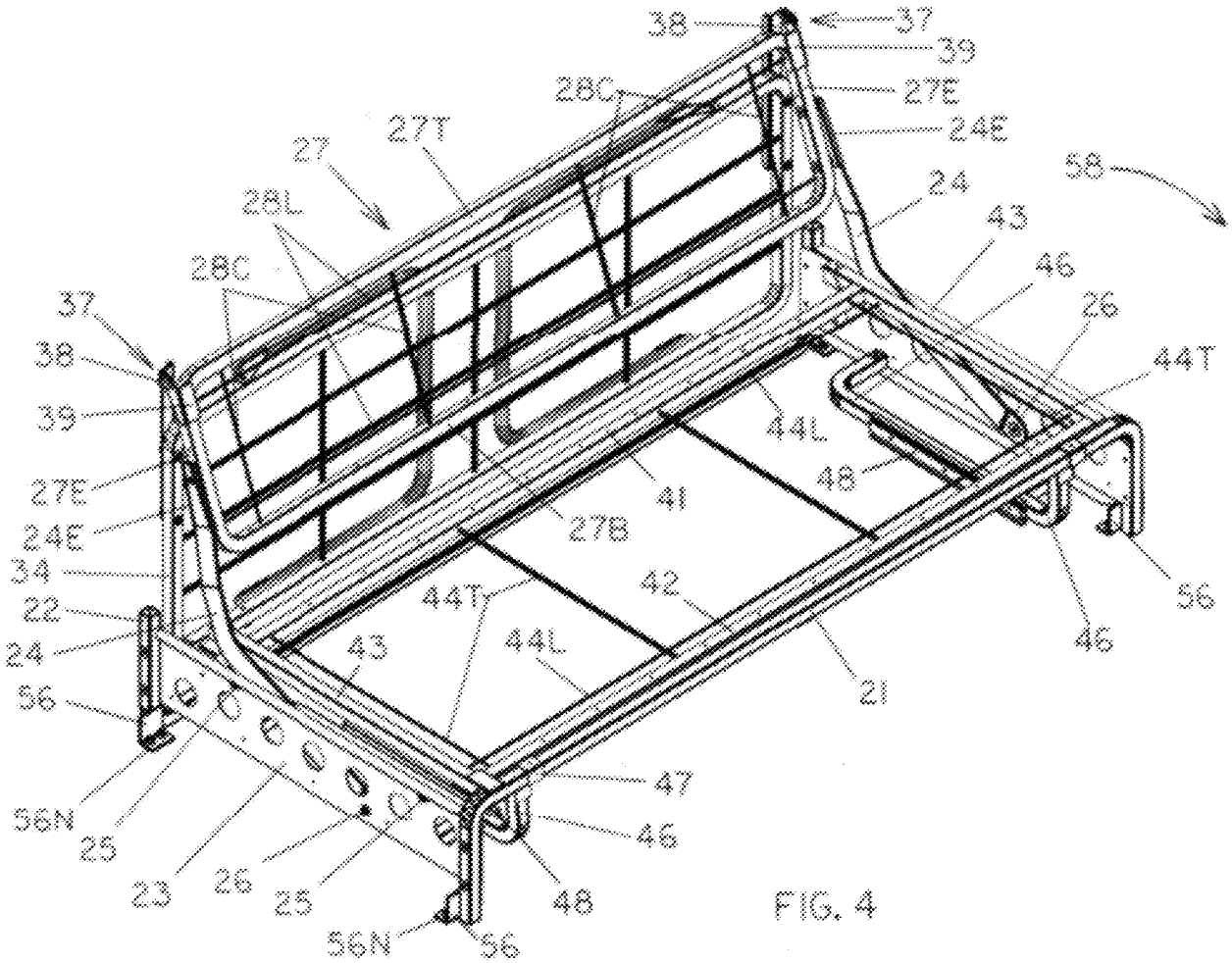
FIG. 4 is a front perspective view of the metal framework of the unit in the sofa configuration of FIG. 1.
Figure 5:
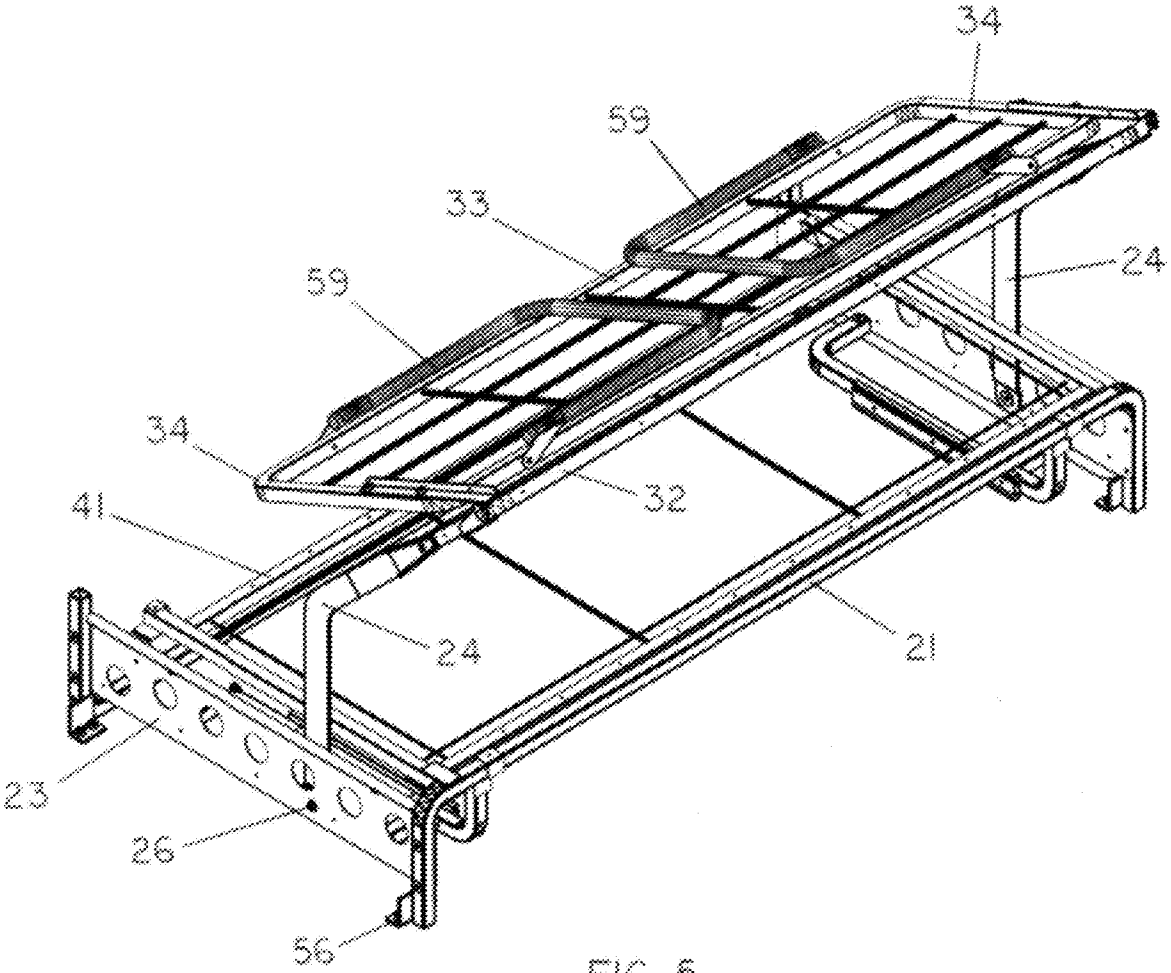
FIG. 5 is a perspective view of the unit in the phase of conversion to a bed.
Figure 14:
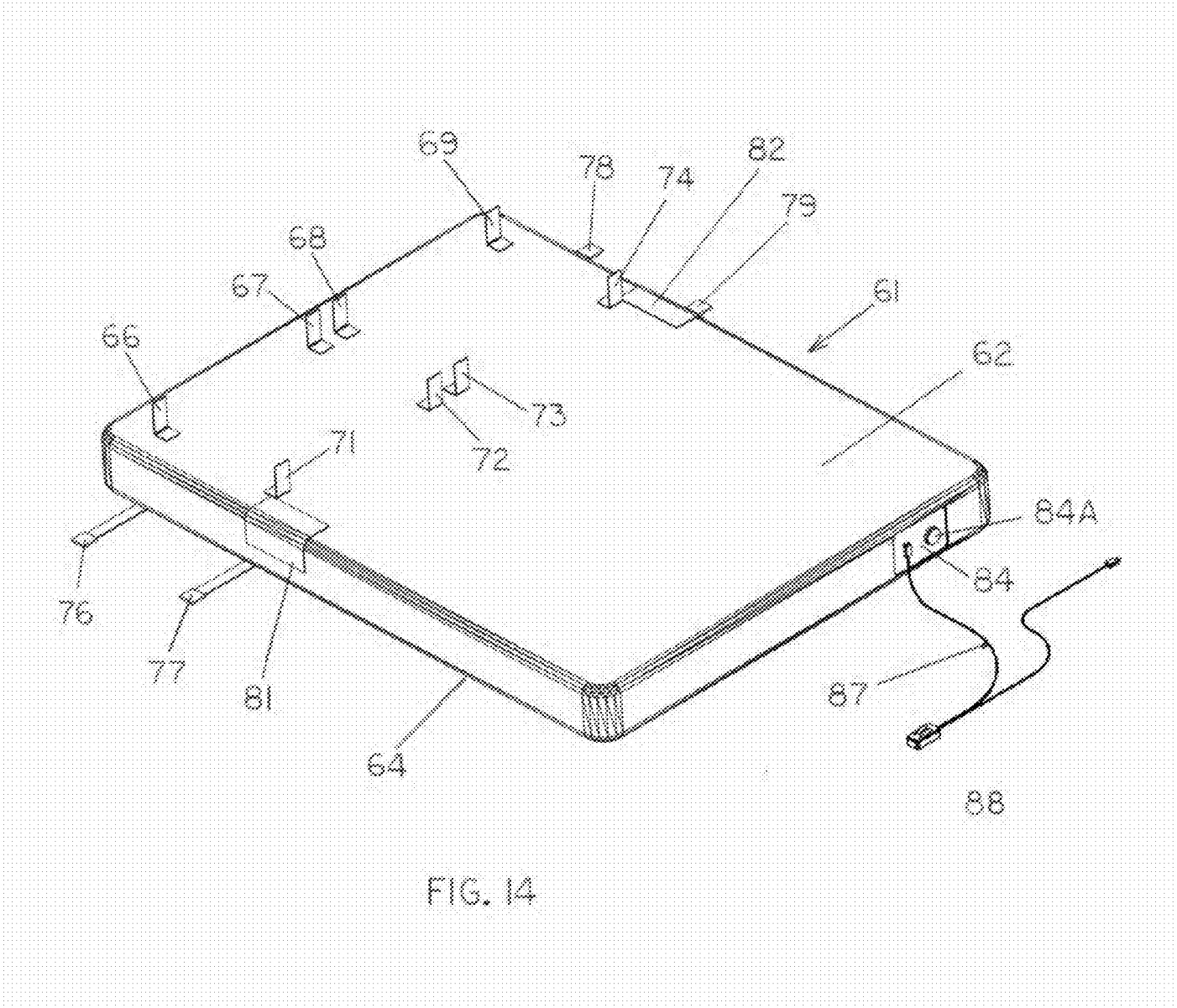
FIG. 14 is a bottom perspective view looking at the head end of the mattress.

Referring now to FIGS. 11 through 15 along with FIGS. 2 and 4, there is shown an air mattress assembly 61 which includes a basic air mattress with, according to a feature of the illustrated embodiment of the present invention, a protective bag 62. The mattress has a top sleeping surface 63 which may be flocked, if desired. The protective bag may be made of a Nylon brand polyester bag, as an example, secured to the mattress top by a zipper 64 around the perimeter of the top. The illustrated bag encloses the mattress except the top. Hook-and-loop fastening materials are used to secure the mattress to the extension frame loop. For simplicity of reference, these materials will be referred to as Velcro, although other brands may also be used. Velcro loop strips 66-69 and 71-74 are sewed to the bottom of the bag 62 at various locations as shown in FIG. 14. They are used to fasten the mattress, (in the bag) to the extension frame. For this purpose, Velcro hook strips with self-sticking adhesive backs are wrapped around the extension frame loop rails at locations shown in FIGS. 2 and 6, where the location for each of the Velcro loop strip attachment is to be made is given the same reference numeral as the loop strip. In addition, and referring to FIGS. 2 and 11-15, each of straps 76-79 of elastic webbing, has Velcro loops folded in half over the free end of the elastic and the other end is sewn to the sides of the bag in the seam for the zipper 64. The strap is stretched around the side of the mattress and down across part of the extension frame assembly, with the free end Velcro loop secured to the Velcro hook wrapped around one of the wires such as 36C FIGS. 2 and 9. Thus it puts tension on the mattress so that, as the mattress is deflated, the straps will pull the bag sides inward toward the middle, away from the side frame members and avoid getting it caught as the apparatus is folded up, and keeping it out of sight when the apparatus has been restored to sofa configuration. The bag also has re-enforcement strips 81 and 82 at the sides of the mattress bag 62 to avoid wear against the frame at the location of the hinges 37.

At the mattress head end of the bag, there is an internally mounted air pump 84 (FIG. 14). While various types and brands of pump may be used, an example has a three-position function control 84A and an electrical control cord 87 from a hand held remote controller 88 (FIG. 3).

Figure 15:
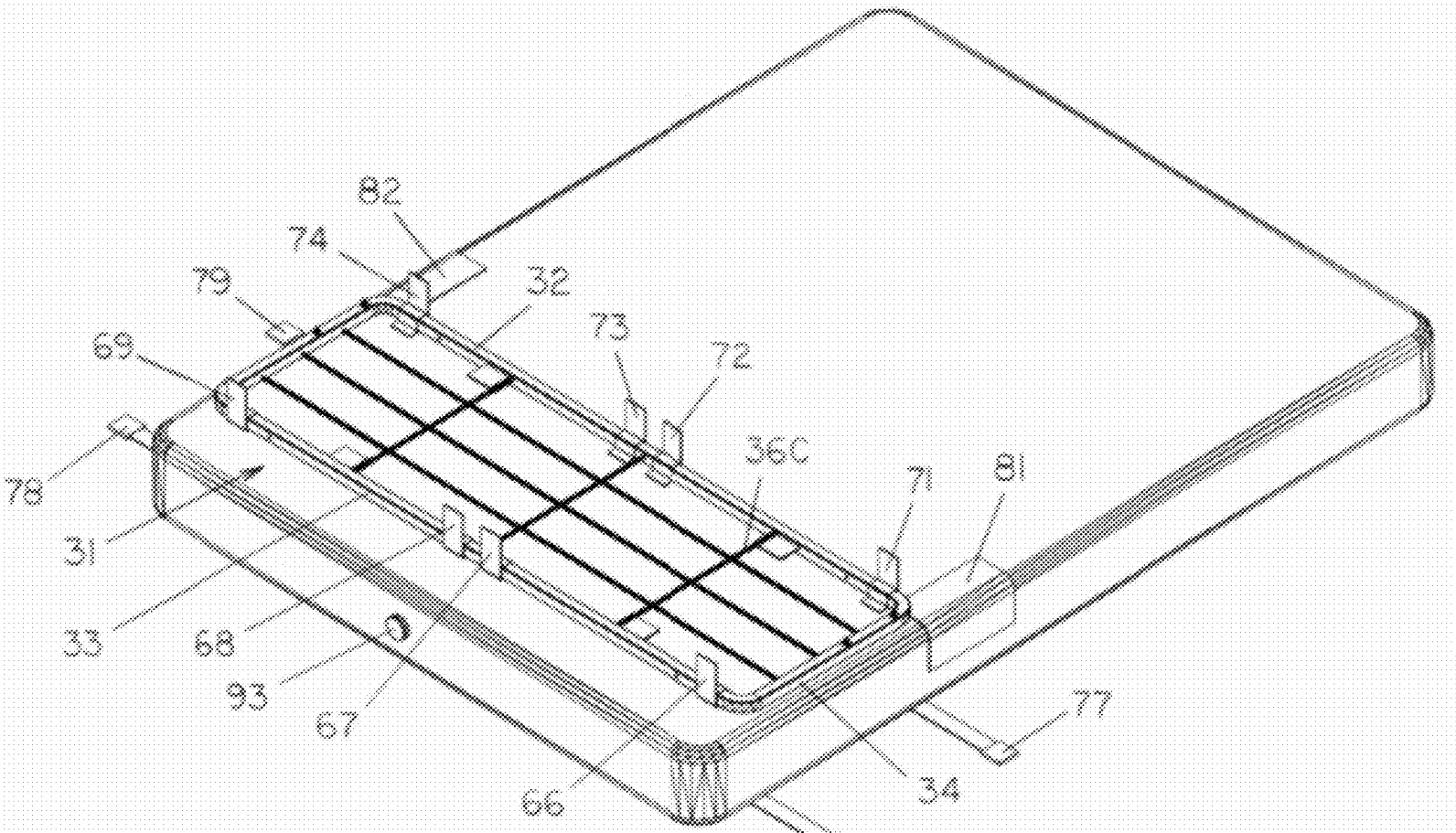
FIG. 15 is a bottom perspective view looking at the foot end of the mattress with an extension frame attached to the mattress, but legs omitted to simplify the illustration.

FIG. 15 shows a mattress looking at the foot end, bottom side up. A large capped exhaust and auxiliary filling port 93 is at the foot end of the mattress. In this view, the extension frame is shown on the bottom of the foot end portion of the mattress, ready to be secured to the mattress by the Velcro tabs.

Operation

Referring now to FIGS. 4 through 9, conversion from sofa to a bed begins with pulling the back assembly 14 forward in the direction of the arrow 58 (FIGS. 1 and 4). As this is done, because of the location of the swing-arm pivots, the roll-over back frame loop 27 will rise and the back assembly 14 rises and moves upward to the position shown in FIG. 5. As this occurs, the foot portion of the air mattress which is strapped at 66-69 (FIG. 2) directly to the lower cross rail 33 of the extension frame loop, is lifted from its original position near the mattress roll at the bottom rear of the sofa. Further pulling forward of the back frame assembly to the position of FIG. 6, where the front portions of the swing arms stop against abutments, brings the drop-down legs 59 into position where they can be lifted easily about their pivot pins to the position shown in FIG. 7, where they are essentially locked in a slightly outwardly spread orientation by the abutting engagement of their ends with the rails 32 and 33. Then the rail 33 is pulled upward and forward about the hinge axes pins 38 and downward to the position shown in FIG. 9, whereupon the drop-down legs are in position against the floor to thereupon support the foot of the bed. As all of this occurs and, because the foot end of the air mattress has been attached to the foot end rail of the extension frame loop, the air mattress is fully deployed on top of the seat cushions 12 and 13 and on top of the springs of the roll-over back frame loop 27 and extension frame loop 31. At this time, the inflation can be commenced by use of the hand-held controller 88 or switch 84A on pump 84 to control the air pump 84 and turn it on in the inflation mode.

Figure 6:
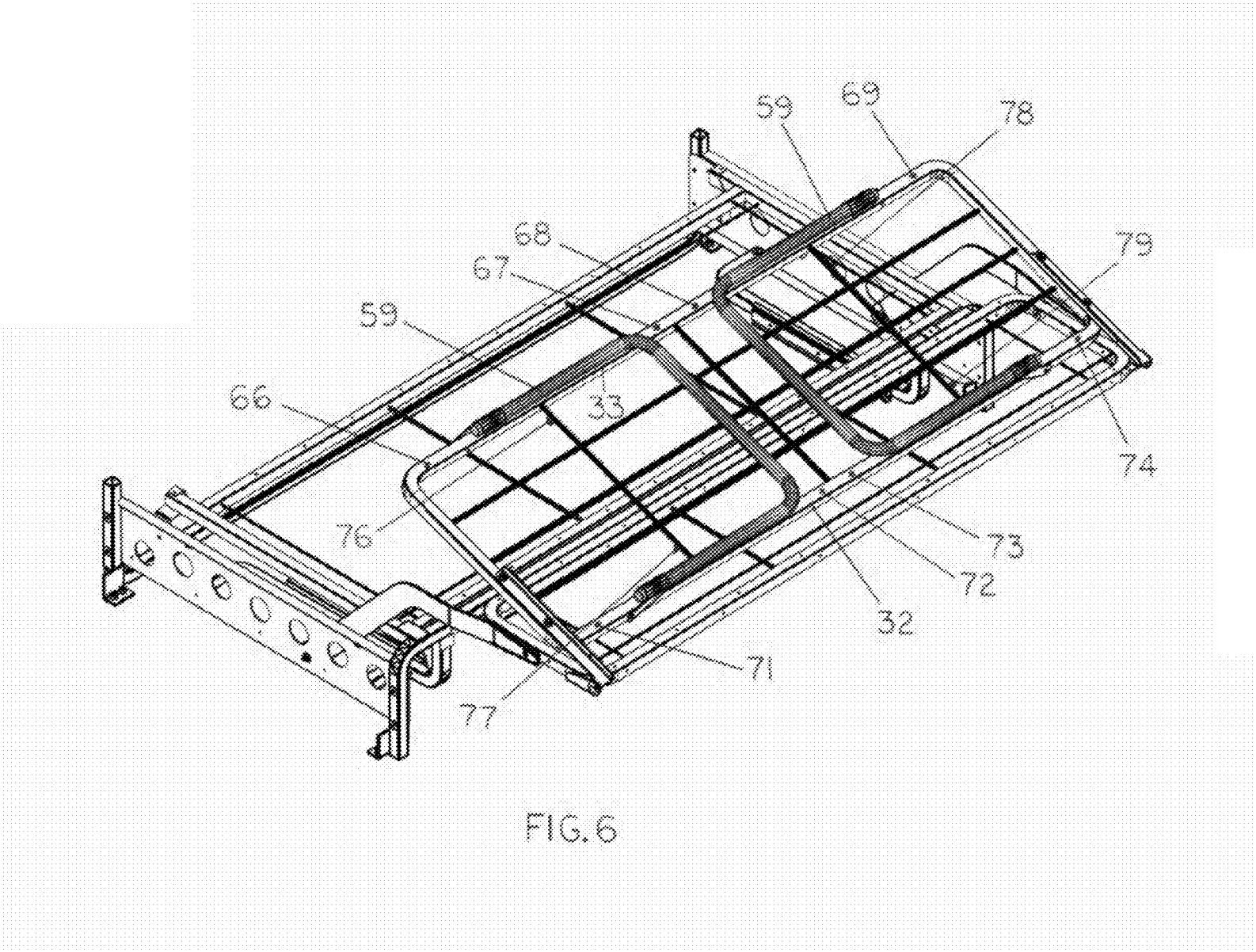
FIG. 6 is a perspective view of the unit further advanced toward the bed configuration.
Figure 7:
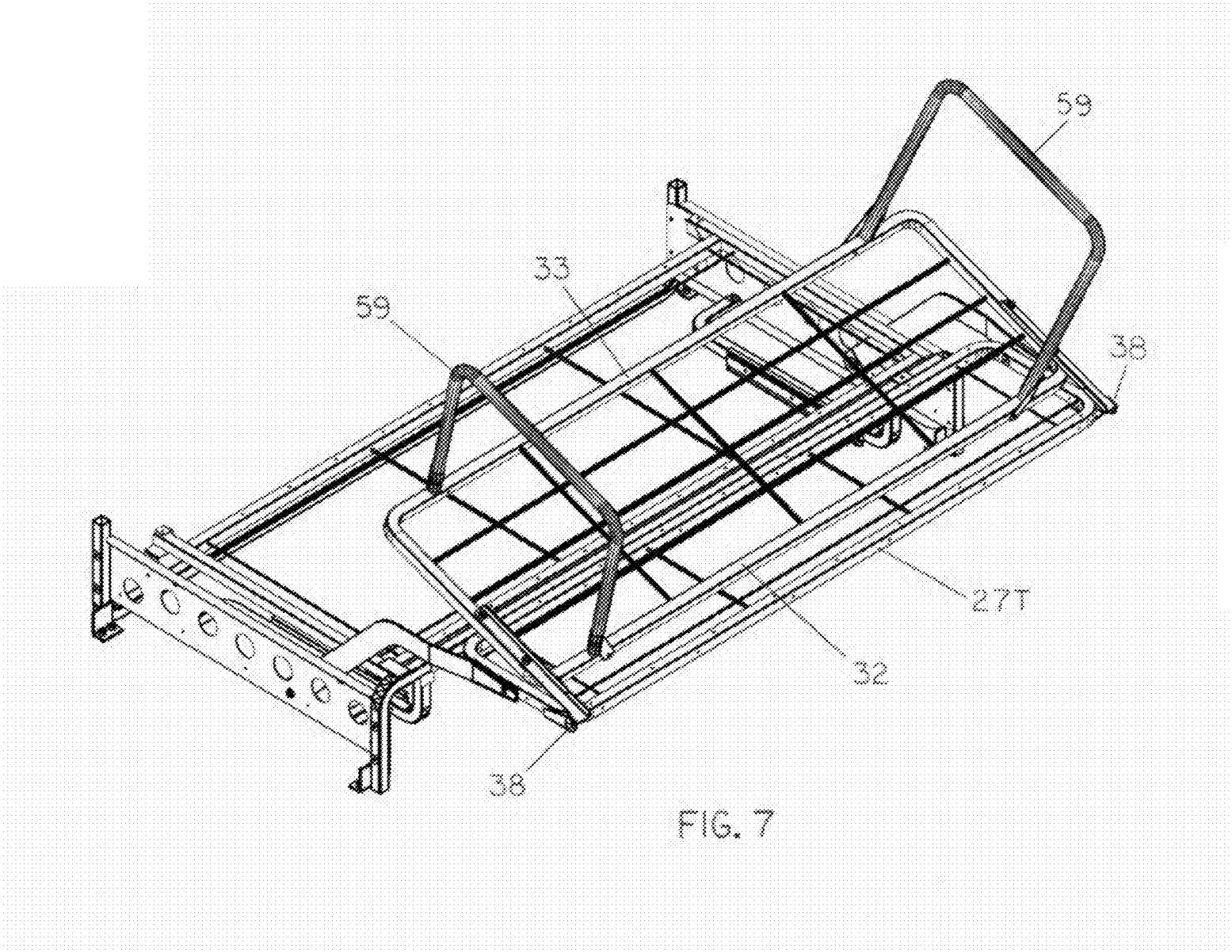
FIG. 7 is a front perspective view of the unit in a further advanced step in which the drop-down leg units have been pulled upward from the inverted back frame.
Figure 8:
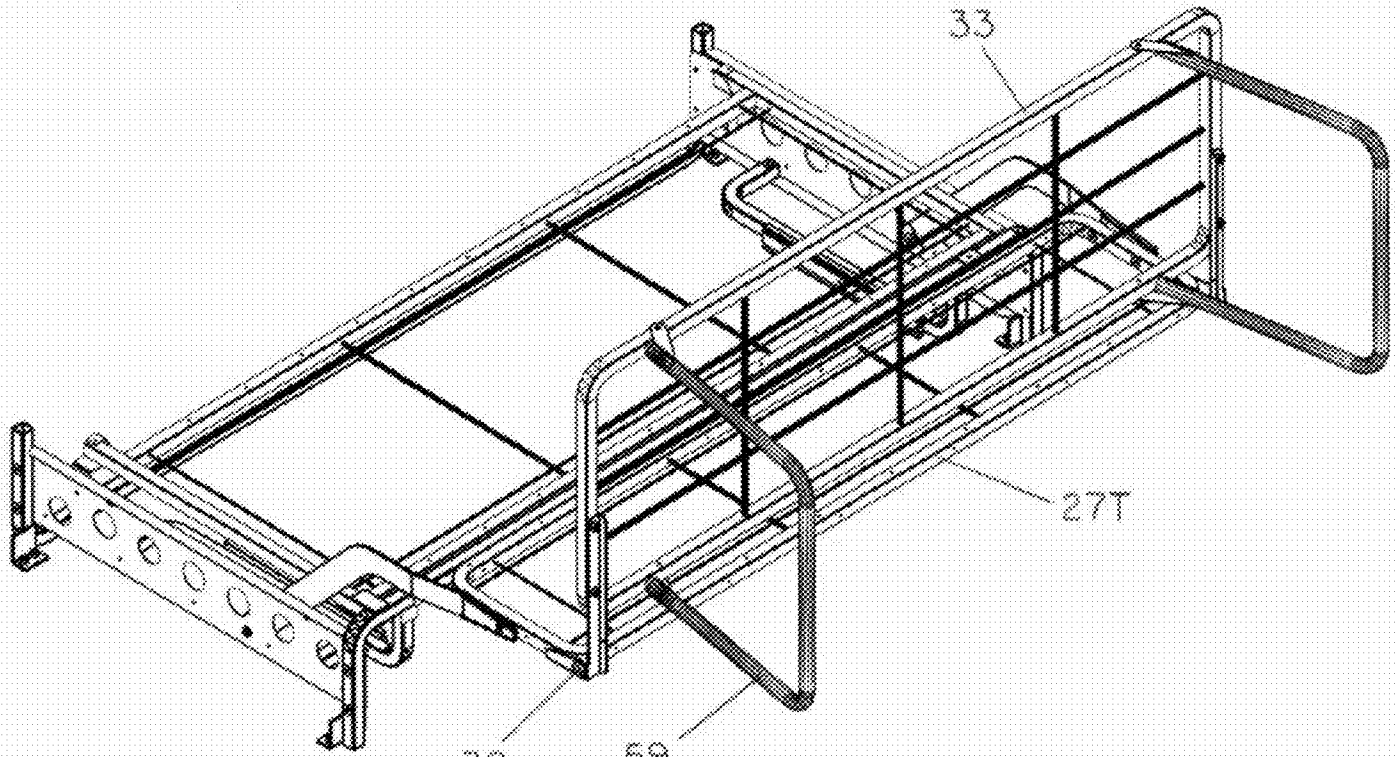
FIG. 8 is a view where the inverted back frame has been moved upward.
Figure 9:
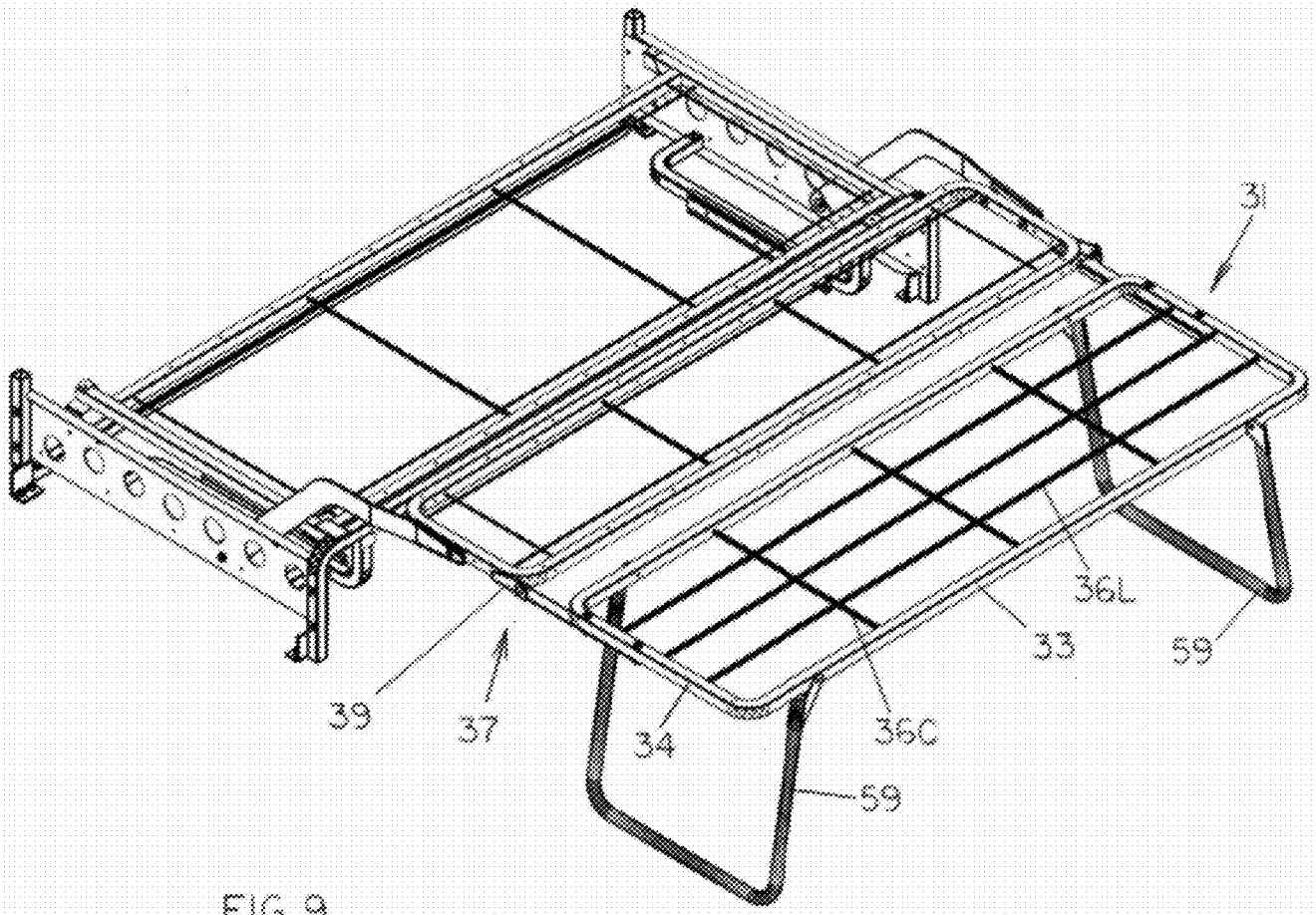
FIG. 9 is a view where the back frame has been fully opened and is supported on the floor.

To convert the bed back to the sofa, the steps are reversed. First of all, the motor itself in the pump is reversed by use of the controller 88 or pump mounted switch 84A to withdraw air from the air mattress. Similarly, in order to expedite the deflation, the port 93 (FIG. 3) in the foot end of the air mattress can be opened by hand. After the air mattress is fully deflated, the foot end of the bed can be raised by hand to the position such as shown in FIG. 8, causing the air mattress to begin to fold adjacent the roll-over hinges 37. The straps 76-79 keep the deflated mattress correctly aligned and engaged against the extension frame loop during this raising and further turning of the roll-over extension frame loop toward the rear. The mattress will fold upon itself between the extension frame loop and the roll-over back frame loop 27. When the extension frame loop is in the position shown in FIG. 7, the drop-down legs 59 can be folded flat easily against the back of the extension frame as shown in FIG. 6. Then by lifting the rail 27T of the back frame loop 27 from the position shown in FIG. 6 to that shown in FIG. 5, the head end of the mattress, where the air pump is located, will begin to slide downward over the back ends of the seat cushions 12 and 13 toward the floor. As this is done, the portion of the air mattress hanging from the extension frame near the hinges 37, simply flows (cascades) down over the back ends of the seat cushions 12 and 13 down to the floor on top of and slightly behind the main frame rear rail 22 to the rest position shown in FIG. 2. This function all occurs within the sofa's footprint thus making it a "zero wall" or "wall hugger" feature. Then, any bedding that might have been used on the inflated mattress in making the bed, can be returned to the storage drawer 16 by simply grasping the top of the drawer face and pulling the drawer out.

As suggested above, there are some features can make a convertible sofa more attractive. In this sofa, the seat back can be pulled off the swing arms when desired. The extension frame with mattress attached can be separated from the seat back frame by removing screws attaching it to the hinges. The mattress can be separated from the extension frame by simply releasing the Velcro straps. The seat cushion can be removed by removing two lock screws from a bracket holding the seat cushion frame, pushing the cushion rearward a short distance, then lifting it slightly and then pulling it out the front. The arms 17 are removable from the base frame by removing several screws in each arm. Therefore, this convertible sofa has many features making it easy to take into the intended site of use, disassembled to the extent which may be needed to get through doorways and go around corners, and readily assembled at the site. Yet it provides a bed which can have a full Queen 60"×80" or Full size 54"×74" mattress, depending on frame sized used. But to convert from sofa to bed configuration, no disassembly of the apparatus, or removal of cushions, is needed. An example of a useful pump is brand; EZ 111 AC PUMP; Model INSTA 111 04-01; manufactured by TWW in China.

While an embodiment of the invention has been illustrated and described in detail in the drawings and foregoing description, the same is to be considered as illustrative and not restrictive in character, it being understood that all changes and modifications that come within the spirit of the invention are desired to be protected.

What is claimed is:

1. A method of converting from a sofa configuration to a bed configuration, the method comprising:

providing a sofa having:

a back;

a base;

a first platform positioned substantially horizontally in the sofa's base;

a second platform pivotably coupled to the base and positioned substantially non-horizontally to define a portion of the sofa's back;

a third platform having an upper edge, the third platform being pivotably coupled near the third platform's upper edge to the second platform and positioned substantially non-horizontally to define a portion of the sofa's back; and an inflatable mattress that is coupled to the third platform of the first, second and third platforms, and which is supported by all of the platforms after the sofa has been converted to the bed configuration;

pivoting the second platform to position the second platform in front of and substantially coplanar with the first platform;

pivoting the third platform to position the third platform in front of and substantially coplanar with the second platform.

2. The method of claim 1, further comprising:

converting the bed back to the sofa without moving the sofa base.

3. The method of claim 1, wherein said providing a sofa further comprises:

providing two angled connecting members that couple the base to the second platform, the angled connecting members being configured to transfer sufficient force from the base to the second platform to cause the second platform to support the back of a user when the sofa is in the sofa configuration.

4. The method of claim 1 in which said providing a sofa provides a sofa in which the only platform that the inflatable mattress couples to is the third platform.

5. The method of claim 1 in which said providing a sofa provides an inflatable mattress assembly having an inflatable mattress and a bag, and the inflatable mattress assembly further includes fastening material attached thereto coupling with only the third one of the platforms.

6. The method of claim 5 wherein the fastening material is attached to the bag.

7. A method of converting from a sofa configuration to a bed configuration, the method comprising:

providing a sofa having:

a back;

a base;

a first platform positioned substantially horizontally in the sofa's base;

a second platform pivotably coupled to the base and positioned substantially non-horizontally to define a portion of the sofa's back;

a third platform having an upper edge, the third platform being pivotably coupled near the third platform's upper edge to the second platform and positioned substantially non-horizontally to define a portion of the sofa's back;

providing an inflatable mattress that is coupled with one of the first, second, and third platforms, and which is supported by all of the platforms after the sofa has been converted to the bed configuration;

providing a bag for receiving the inflatable mattress, the bag including fastening material attaching the inflatable mattress to the third platform;

pivoting the second platform to position the second platform in front of and substantially coplanar with the first platform;

pivoting the third platform to position the third platform in front of and substantially coplanar with the second platform.

8. The method of claim 7 wherein said providing a sofa further comprises:

providing two angled connecting members that couple the base to the second platform, the angled connecting members being configured to transfer sufficient force from the base to the second platform to cause the second platform to support the back of a user when the sofa is in the sofa configuration.

9. The method of claim 7, further comprising:

converting the bed back to the sofa without moving the sofa base.

10. A method of converting from a sofa configuration to a bed configuration, the method comprising:

providing a sofa having:

a back;

a base including a seat surface for seating an occupant in the sofa configuration;

a first platform positioned substantially horizontally in the sofa's base;

a second platform pivotably coupled to the base and positioned substantially non-horizontally to define a portion of the sofa's back;

a third platform having an upper edge, the third platform being pivotably coupled near the third platform's upper edge to the second platform and positioned substantially non-horizontally to define a portion of the sofa's back; and a drawer supported by the sofa's base below the seat surface for storing sofa or bedding items in the drawer; and pivoting the second platform to position the second platform in front of and substantially coplanar with the first platform;

pivoting the third platform to position the third platform in front of and substantially coplanar with the second platform.

11. The method of claim 10, wherein the back includes a back cushion and said method further comprises pivoting of the second and third platforms into the bed configuration being accomplished without removing the back cushion from the sofa.

12. The method of claim 10, wherein said providing a sofa further provides an inflatable mattress that is coupled with at least one of the first, second and third platforms, and which is supported by all of the platforms after the sofa has been converted to the bed configuration.

13. A method of converting from a sofa configuration to a bed configuration requiring minimum rearward wall clearance, the method comprising:

providing a sofa having:

a back;

a base;

a first platform positioned substantially horizontally in the sofa's base;

a second platform pivotably coupled to the base and positioned substantially non-horizontally to define a portion of the sofa's back;

a third platform having an upper edge, the third platform being pivotably coupled near the third platform's upper edge to the second platform and positioned substantially non-horizontally to define a portion of the sofa's back; and a plurality of front legs and rear legs, said rear legs not extending rearwardly from the rearmost position of the second and third platforms in the sofa's back in the sofa configuration;

wherein said providing a sofa further provides an inflatable mattress that is coupled with at least one of the first, second and third platforms, and which is supported by all of the platforms after the sofa has been converted to the bed configuration;

pivoting the second platform to position the second platform in front of and substantially coplanar with the first platform;

pivoting the third platform to position the third platform in front of and substantially coplanar with the second platform.

14. A method of converting from a sofa configuration to a bed configuration requiring minimum rearward wall clearance, the method comprising:

providing a sofa having:

a back;

a base;

a first platform positioned substantially horizontally in the sofa's base;

a second platform pivotably coupled to the base and positioned substantially non-horizontally to define a portion of the sofa's back;

a third platform having an upper edge, the third platform being pivotably coupled near the third platform's upper edge to the second platform and positioned substantially non-horizontally to define a portion of the sofa's back; and a plurality of front legs and rear legs, said rear legs not extending rearwardly from the rearmost position of the second and third platforms in the sofa's back in the sofa configuration;

wherein the back includes a back cushion and said method further comprises pivoting of the second and third platforms into the bed configuration being accomplished without removing the back cushion from the sofa;

pivoting the second platform to position the second platform in front of and substantially coplanar with the first platform;

pivoting the third platform to position the third platform in front of and substantially coplanar with the second platform.

15. A method of converting from a sofa configuration to a bed configuration requiring minimum rearward wall clearance, the method comprising:

providing a sofa having:

a back;

a base;

a first platform positioned substantially horizontally in the sofa's base;

a second platform pivotably coupled to the base and positioned substantially non-horizontally to define a portion of the sofa's back;

a third platform having an upper edge, the third platform being pivotably coupled near the third platform's upper edge to the second platform and positioned substantially non-horizontally to define a portion of the sofa's back; and a plurality of front legs and rear legs, said rear legs not extending rearwardly from the rearmost position of the second and third platforms in the sofa's back in the sofa configuration;

pivoting the second platform to position the second platform in front of and substantially coplanar with the first platform;

pivoting the third platform to position the third platform in front of and substantially coplanar with the second platform and converting the bed back to the sofa without moving the sofa base.

* * * * *